US006466763B1

(12) United States Patent
Campbell et al.

(10) Patent No.: US 6,466,763 B1
(45) Date of Patent: Oct. 15, 2002

(54) CONVEYOR AND WASTE TONER RESERVOIR FOR AN IMAGE-FORMING APPARATUS

(75) Inventors: Alan Stirling Campbell, Lexington, KY (US); Paul Douglas Horrall, Lexington, KY (US); James John Molloy, Lexington, KY (US); Franklin Joseph Palumbo, Nicholasville, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/551,804

(22) Filed: Apr. 18, 2000

(51) Int. Cl.[7] ..... G03G 21/12
(52) U.S. Cl. ..... 399/360
(58) Field of Search ..... 399/120, 358, 399/360, 123, 35

(56) References Cited

U.S. PATENT DOCUMENTS

| | | | | |
|---|---|---|---|---|
| 3,927,937 A | | 12/1975 | de Keyzer | |
| 3,950,092 A | | 4/1976 | Zoltner | |
| 4,218,126 A | | 8/1980 | Takeichi | |
| 4,593,997 A | | 6/1986 | Fox et al. | |
| 4,630,653 A | | 12/1986 | Kan | 141/83 |
| 5,101,961 A | | 4/1992 | Bengtson et al. | |
| 5,146,270 A | * | 9/1992 | Matsuo et al. | 399/112 |
| 5,268,720 A | | 12/1993 | Saitoh et al. | 355/246 |
| 5,289,241 A | * | 2/1994 | Sugiyama et al. | 399/120 |
| 5,309,211 A | * | 5/1994 | Yoshioka | 399/113 |
| 5,381,217 A | * | 1/1995 | Ishida | 399/120 |
| 5,436,703 A | | 7/1995 | DeYoung et al. | 355/245 |
| 5,541,715 A | | 7/1996 | Katoh et al. | 355/260 |
| 5,617,195 A | | 4/1997 | Torimaru et al. | 399/27 |
| 5,742,882 A | | 4/1998 | Lee | 399/258 |
| 5,815,784 A | | 9/1998 | Kasahara et al. | 399/358 |
| 5,848,342 A | | 12/1998 | Tanda | 399/358 |
| 5,852,762 A | | 12/1998 | Hatta et al. | 399/358 |
| 5,933,696 A | | 8/1999 | Howard et al. | |
| 5,970,303 A | | 10/1999 | Bares et al. | |

FOREIGN PATENT DOCUMENTS

JP 60-230173 * 11/1985

* cited by examiner

*Primary Examiner*—Robert Beatty
(74) *Attorney, Agent, or Firm*—David D. Kalish

(57) ABSTRACT

A waste toner removal device for transporting toner from a photoconductive drum within an image-forming apparatus. The invention includes a waste toner reservoir having outer walls forming an interior chamber for housing toner removed from the photoconductive drum. An opening is positioned within the outer walls into the interior chamber forming an upper chamber section extending above the opening and a lower chamber section extending below the opening. An auger extends along the photoconductive drum and unobstructed into the opening of the waste toner reservoir. The auger includes helical blades extending outward for moving the toner from the photoconductive drum into the waste toner reservoir. A pumping cylinder having a generally cylindrical shape extends around the auger adjacent to the waste toner reservoir. The diameter of the pumping cylinder is approximately equal to the helical blades wherein rotation of the auger creates a pumping action for moving toner into the said upper and lower chamber sections.

9 Claims, 7 Drawing Sheets

CONVEYOR AND WASTE TONER RESERVOIR FOR AN IMAGE-FORMING APPARATUS

BACKGROUND OF THE INVENTION

1. Field of the Invention

The present invention relates generally to an image-forming apparatus and, more particularly, to an auger and waste toner reservoir for removing and storing residual toner from a photoconductive drum.

2. Description of the Prior Art

Image forming devices including copiers, laser printers, facsimile machines, and the like, include a photoconductive drum (hereinafter referred to as a drum) having a rigid cylindrical surface that is coated along a defined length of its outer surface. The surface of the drum is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is brought into contact with the drum's photoconductive surface. A recording sheet, such as a blank sheet of paper, is then brought into contact with the photoconductive surface and the toner thereon is transferred to the recording sheet in the form of the latent electrostatic image. The recording sheet is then heated thereby permanently fusing the toner to it. In preparation for the next image forming cycle, the photoconductive surface may be discharged by an erase lamp and residual toner is removed by a cleaner blade, such as a brush or scraper, that contacts the drum surface. The toner falls into an auger or conveyor that moves the toner away from the drum. A waste toner reservoir is often positioned adjacent to the drum for housing the residual toner.

Preferably, the overall size of the image forming apparatus is as small as possible. The small size allows a user to more easily move the device, and also requires less space on a user's desk or workstation. Therefore, there is a tradeoff between a large waste toner reservoir that can hold a large amount of residual toner without becoming filled and a smaller reservoir that fits within the image forming device without occupying an excessive amount of space.

Several previous toner removal systems have used fans or other like devices to move the toner away from the drum. Conduits placed along the drums capture and direct the toner to remote areas of the apparatus away from the drum. Fans are placed along the conduits for blowing the toner along the length of the conduit to remote locations where the toner can be removed from the image forming apparatus. These fans add cost to the printer, and a single image forming device often requires more than one fan to adequately move the toner. The fans may also be unreliable, either failing to operate effectively or breaking-down requiring continual maintenance. Breakdowns are especially likely because the fans are constantly exposed to the dry, powdery toner that may clog and foul the fan components. A blocked toner removal system requires the printer to be taken off line and disassembled, which is time consuming and aggravating for a user. Fans additionally add noise to the image-forming process which is undesirable because the devices are often positioned at user's workstations where a quiet atmosphere is maintained for efficient working conditions.

Other waste toner reservoirs have been positioned to use gravity to move the toner away from the drums. As toner is moved by an auger into the reservoir, it falls into the reservoir filling from the bottom to the top and becomes unusable once the level of toner reaches the toner inlet. These gravity systems reduce the effective design alternatives for the apparatus because the positioning of the reservoir relative to the drum is critical. Positioning the reservoir below the drum to utilize the gravity flow often requires an additional amount of space, thereby resulting in an increased overall size of the image forming apparatus. This problem is compounded in color printing devices that have multiple drums and reservoirs.

Thus, there remains a need for a toner removal system for an image-forming apparatus that provides adequate space for holding residual toner but does not require a large amount of space within the apparatus.

SUMMARY OF THE INVENTION

The present invention is directed to a toner removal device for removing residual toner from within an image-forming apparatus. The invention includes a waste toner reservoir aligned along an end of the drum for storing residual toner removed from the drum. An auger extends along the drum and moves the toner into an opening in the waste toner reservoir. The toner is directed into all areas of the waste toner reservoir, both areas above and below the level of the opening providing for sizing and positioning the waste toner reservoir to occupy a minimal amount of room within the interior of the image forming apparatus.

A pumping cylinder may be mounted around the auger adjacent to the waste toner reservoir to further assist in pumping the toner. The pumping cylinder extends around helical blade of the auger such that as the auger rotates, the toner is forced through the pumping cylinder and into the waste toner reservoir. The pumping cylinder assists in preventing the toner from back-flowing from the waste toner reservoir into the areas of the drum. Preferably, the auger extends through the pumping cylinder and into the interior section of the waste toner reservoir to further assist in toner pumping.

DESCRIPTION OF THE PREFERRED EMBODIMENT

Figure 1:
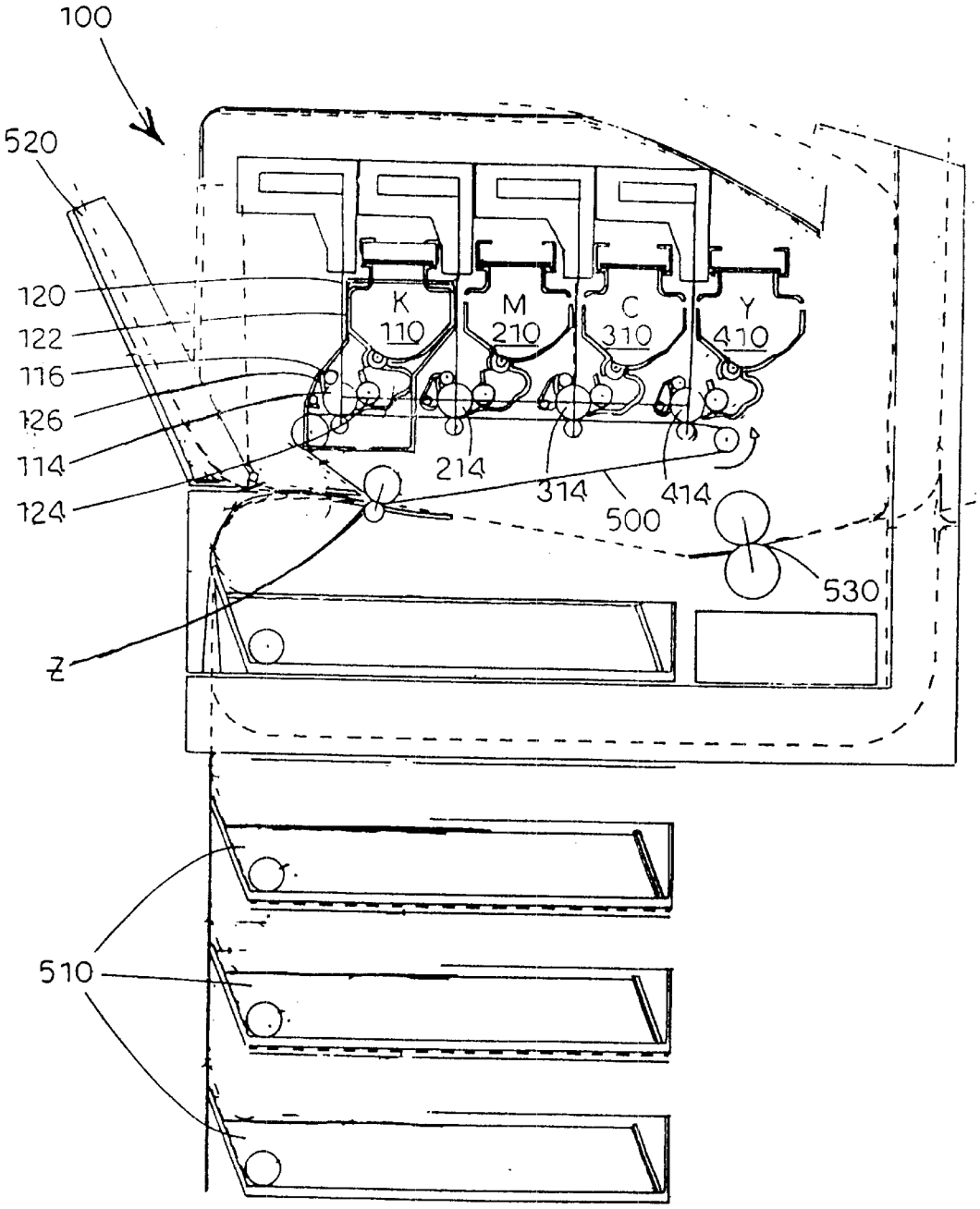
FIG. 1 is a side cut-away view illustrating the elements of an image-forming apparatus.

FIG. 1 illustrates the basic elements of an image forming apparatus and is incorporated for an understanding of the overall electrophotographic image forming process. A four cartridge color laser printer is illustrated as 100, however one skilled in the art will understand that the present invention is applicable to other types of image forming devices using toner for printing through a photoconductive drum. The image forming apparatus, generally designated 100, includes a plurality of similar toner cartridges 110, 210, 310, and 410. Each toner cartridge is of a similar construction but is distinguished by the toner color contained therein. In one embodiment, the device includes a black (K) cartridge 110, a magenta (M) cartridge 210, a cyan (C) cartridge 310, and a yellow (Y) cartridge 410. Each different color toner forms an individual image of a single color that is combined in layered fashion to create the final multi-colored image. The order of the cartridges may vary and is not considered an essential aspect of the present invention.

Each of the toner cartridges is substantially identical and includes a drum, a developing device, and a cleaning device. As the cartridges are identical except for the toner color, the cartridge and elements for forming black images will be described, with the other color image forming units being omitted for simplification.

The drum 114 is generally cylindrically-shaped with at least one end 33 that intermeshes with the image forming device drive gears to provide for a rotational force. The drum 114 has a smooth surface for receiving an electrostatic charge over the surface as the drum rotates past charge roll 116. The drum continuously and uniformly rotates through a laser scanning assembly 120 that directs a laser onto a selective portion of the drum surface forming an electrostatically latent image across the width of the drum representative of the outputted image. The drive gears rotate the drum in a continuous manner, and at a rate that depends on the resolution of the printing. This process continues as the entire image pattern is formed on the drum surface.

After receiving the latent image, the drum rotates through a toner area having a toner bin 122 for housing the toner and a developer roller 124 for uniformly developing toner onto the drum. The toner is a fine powder usually constructed of plastic granules that are attracted and cling to the electrostatic latent image formed by the laser scanning assembly 120.

The drum next rotates past an adjacently-positioned intermediate transfer mechanism belt 500 (hereinafter, ITM belt) where the toner is transferred from the drum 114. As illustrated in FIG. 1, the ITM belt 500 is endless and extends around a series of rollers adjacent to the drums. The ITM belt 500 and each drum 114, 214, 314, 414 are synchronized providing for the toner from each drum to precisely align on the ITM belt during a single pass. By way of example as viewed in FIG. 1, the yellow toner will be placed on the ITM belt, followed by cyan, magenta, and black.

After depositing the toner on the ITM belt, the drum rotates through a cleaning area where residual toner is removed from the surface via a brush or cleaner blade 126. The residual toner is moved via the auger 14 to a waste toner reservoir 12. The drum 114 may pass through an erase area (not shown) having a lamp or other light source for exposing the entire drum surface to light to remove any residual charge and image pattern formed by the laser.

As the drums are being charged and gathering toner, a recording sheet, such as a blank sheet of paper, is being routed to intercept the ITM belt 500. The paper may be placed in one of the lower trays 510, or introduced into the image forming device through a side track tray 520. A series of rollers and belts transports the paper to point Z where the sheet contacts the ITM belt and receives the toner. In many imaging forming apparatus, the sheet receives an electrostatic charge prior to contact with the ITM belt to assist in attracting the toner from the belt. The sheet and attached toner next travel through a fuser 530 having a pair of rollers and a heating element that heats and fuses the toner to the sheet. The paper with fused image is then transported out of the printer for receipt by a user.

Each of the toner cartridges may be removed and replaced within the image forming apparatus. Replacement is usually necessary when there is no toner remaining in the toner bin 122. In a preferred embodiment illustrated in FIG. 1, the cartridges are side loading into the image forming device in a direction substantially perpendicular to the rotation of the ITM belt 500.

Figure 2:
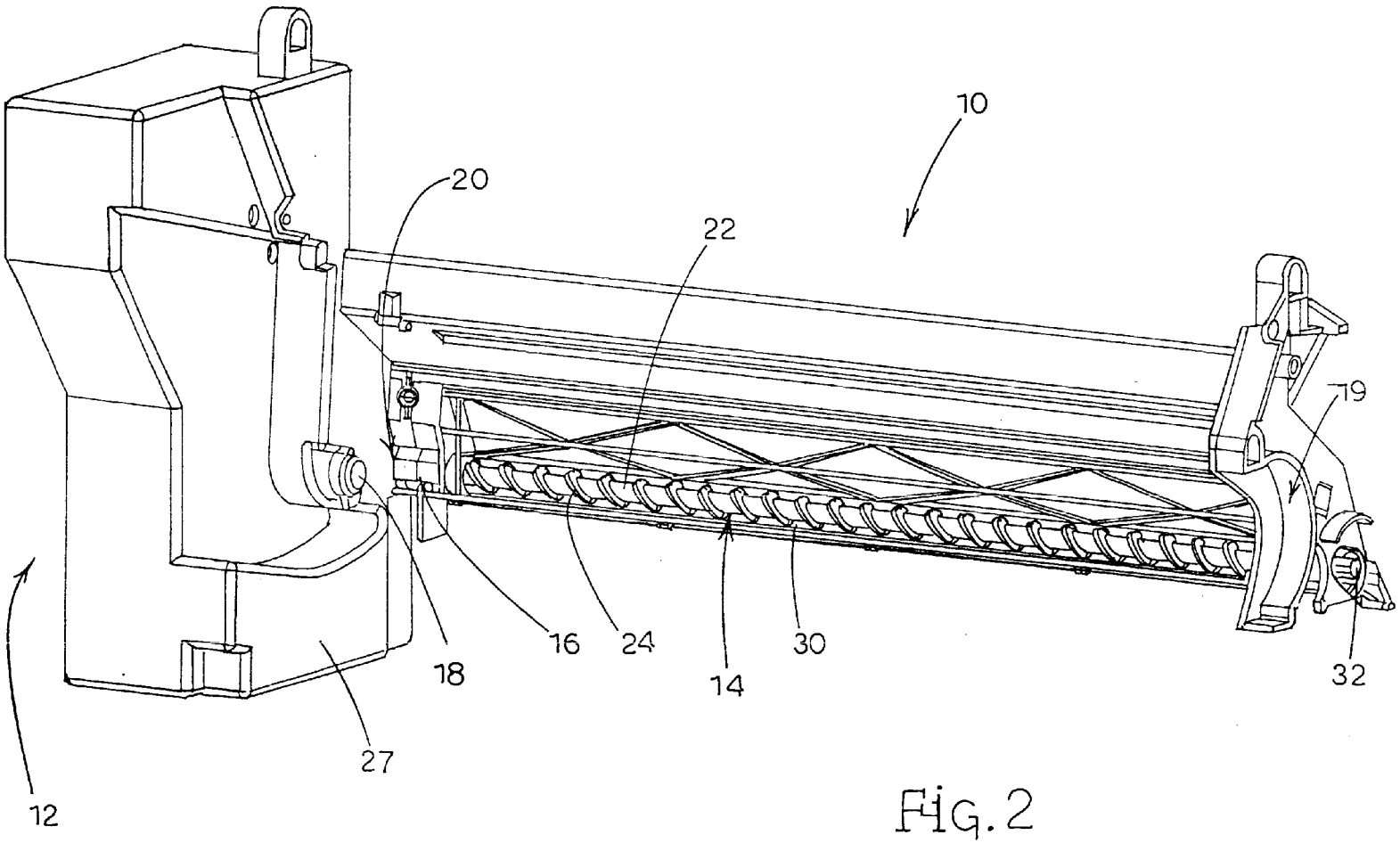
FIG. 2 is a perspective view of the toner removal system illustrating the auger, pumping cylinder, and waste toner reservoir.
Figure 3:
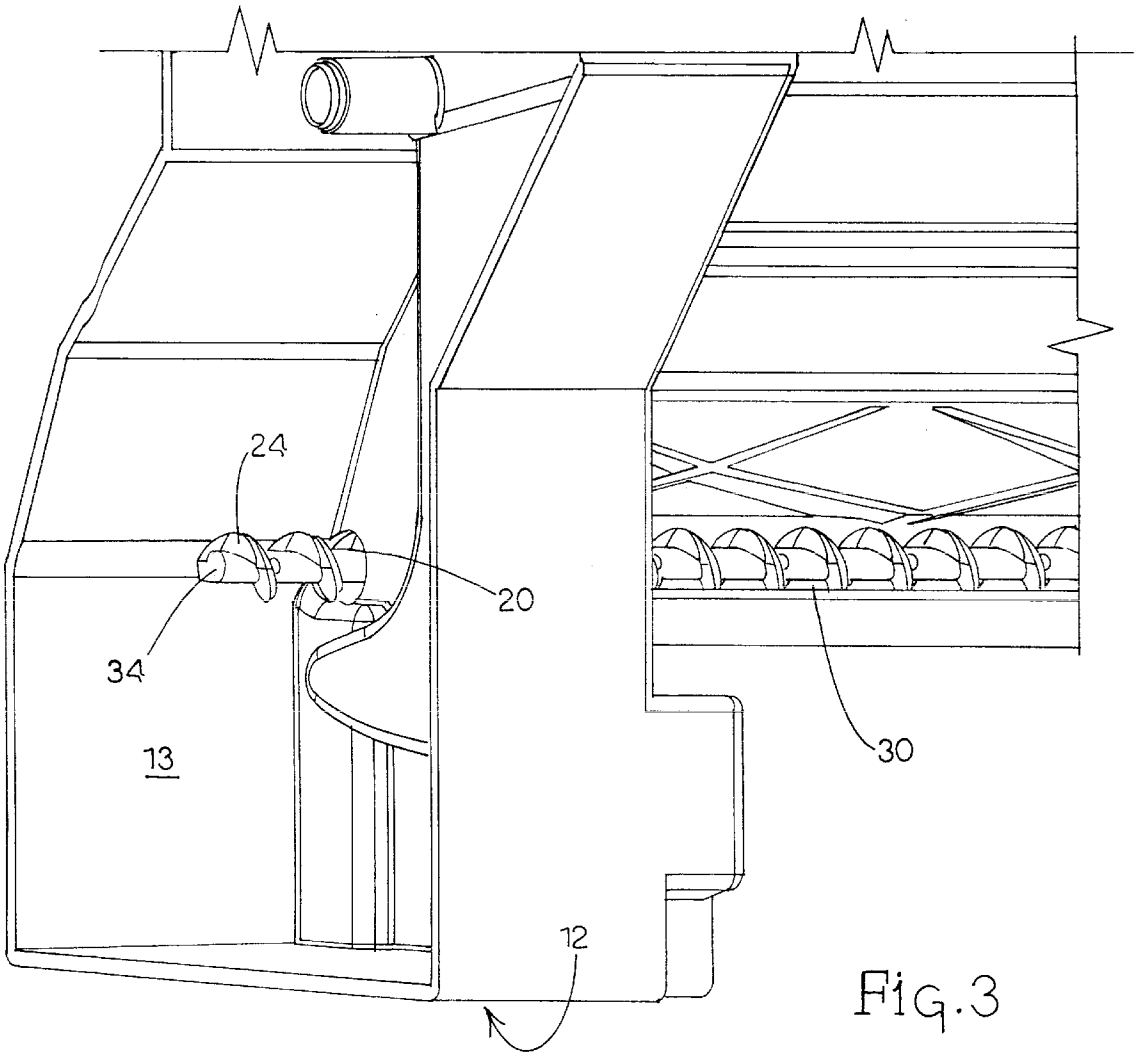
FIG. 3 is a perspective cut-away view of the waste toner reservoir having the wall of the waste toner reservoir cut-away illustrating the auger extending therein.

Turning now to FIG. 2, there is illustrated a waste toner removal system, generally designated as 10, constructed according to the present invention. The device includes a waste toner reservoir 12 having an opening 20 leading into the interior of the reservoir. An auger 14 for transporting residual toner from the drum extends to the waste toner reservoir 12 and into opening 20. A pumping cylinder 16 is positioned around the auger at a point adjacent to the waste toner reservoir for working in combination with the auger for pumping the toner into the waste toner reservoir. The drum 114 is not illustrated in FIG. 2 to allow for illustrating the auger and waste toner reservoir, but would mount between extension 18 and collar 19.

Figure 7:
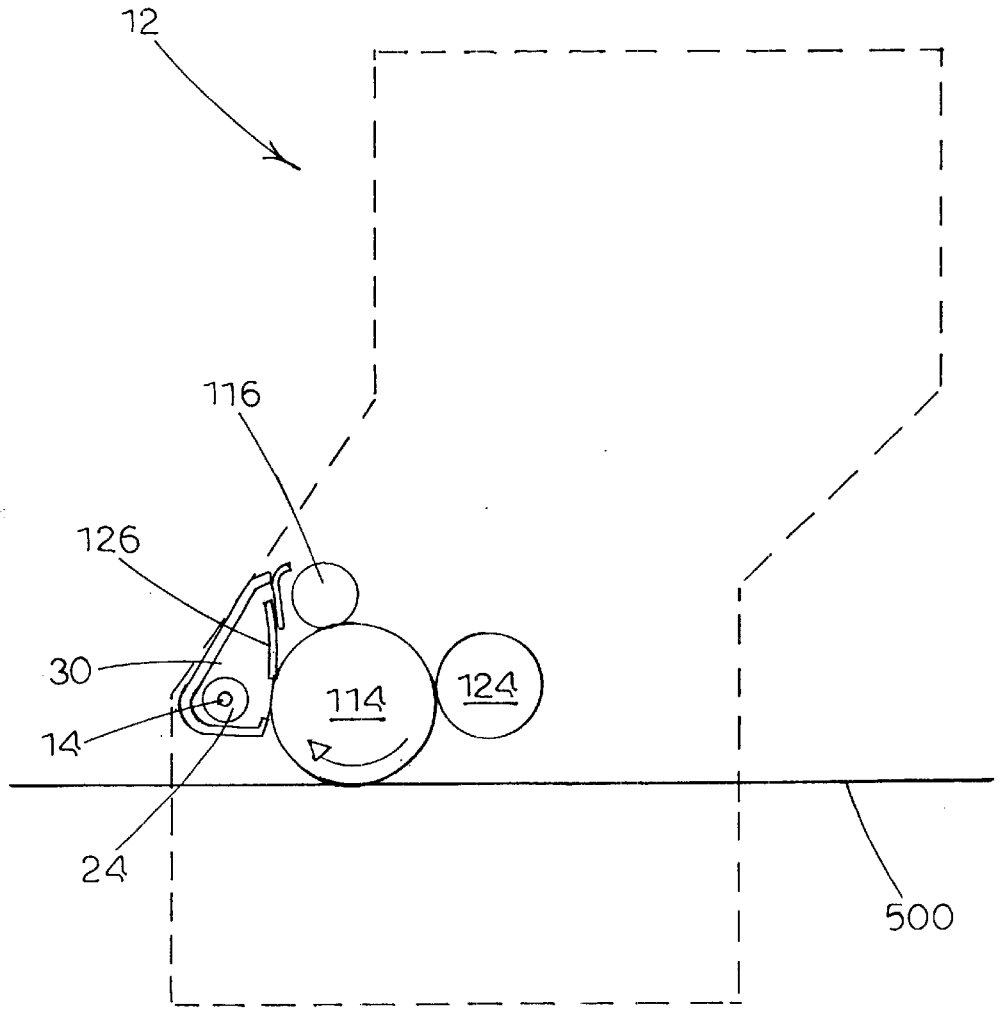
FIG. 7 is a schematic side view illustrating the placement of the auger and waste toner reservoir relative to the drum.

FIG. 7 illustrates a schematic view of the placement of the drum 114 and toner removal device. The position of the charge roll 116, developer roller 124, and ITM belt 500 are illustrated for reference. After the toner has been deposited onto the ITM belt 500, the residual toner is removed from the drum by cleaner blade 126. The toner may alternatively be removed by a brush, or other means commonly known in the art. As the toner exits the drum, it is collected in the auger tray 30 to prevent toner escape that may lead to print defects. The auger 14 with helical blade 24 is positioned within the auger tray 30 and moves the toner away from the drum 114 and into the waste toner reservoir 12. The waste toner reservoir is illustrated by dashed lines as it is preferably positioned at an end of the drum behind the elements, or into the paper as illustrated in FIG. 7.

Figure 4:
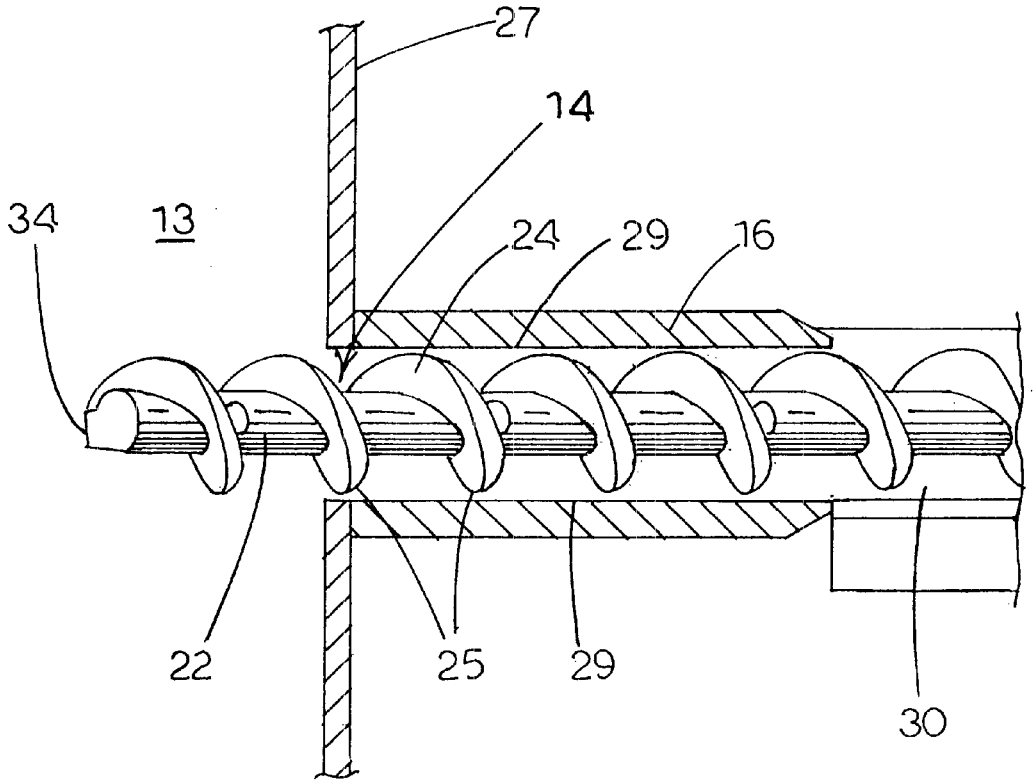
FIG. 4 is a side cross-sectional view illustrating the auger extending within the pumping cylinder.

The auger 14 extends along the length of the drum 114 for moving toner into the waste toner reservoir 12. Auger 14 includes a central shaft 22 and a continuous helical blade 24 that extends the auger length. The auger has a first end 32 having gears or other connection means that connect with drive gears of the image forming device for rotating the auger. The auger has a length such that the second end 34 is positioned within the interior of the waste toner reservoir 12 as illustrated in FIG. 4. The auger 14 extends unobstructed into the waste toner reservoir 12.

Figure 5:
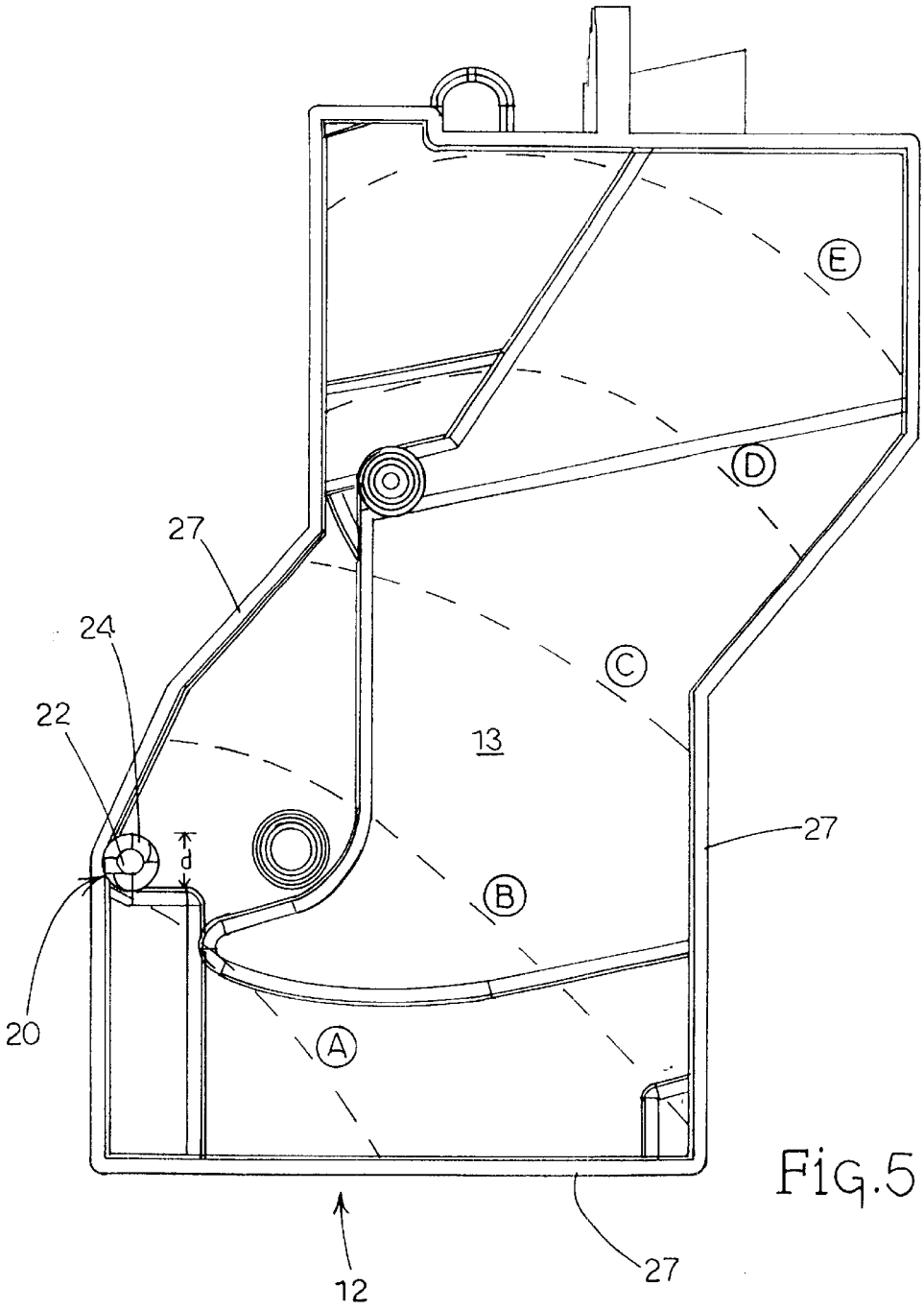
FIG. 5 is a side view of the inner chamber of the waste toner reservoir illustrating the positioning of the opening.
Figure 6:
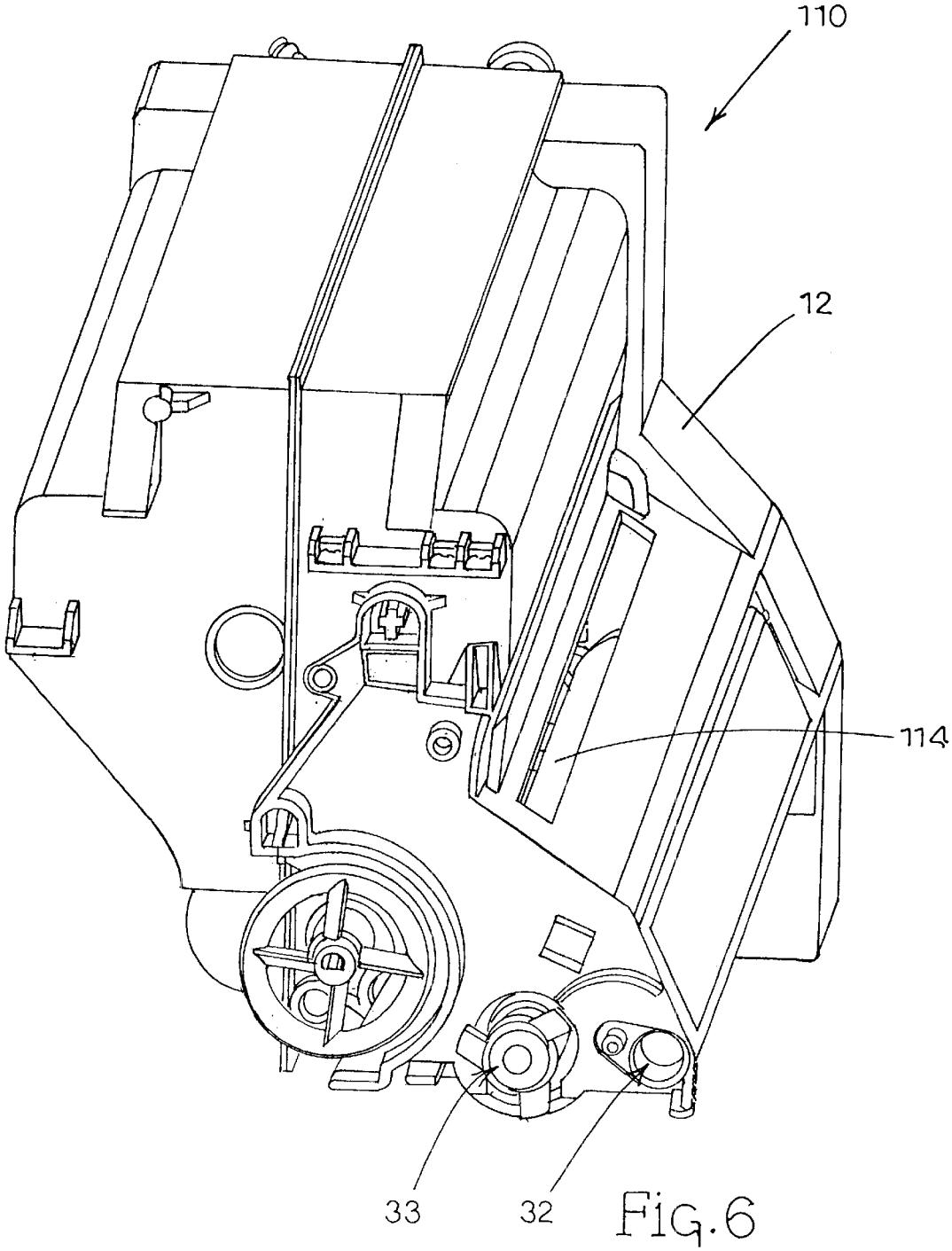
FIG. 6 is a rear perspective view of a cartridge having an auger and waste toner reservoir.

The waste toner reservoir 12 is positioned at one end of the drum and cartridge for storing residual toner. Preferably as viewed in FIG. 6, the dimensions of the waste toner reservoir 12 conform to the dimensions of the cartridge 110 for reducing the size of the cartridge which is important in reducing the overall size of the image-forming apparatus. The waste toner reservoir includes outer walls 27 that form an enclosed interior section 13 for housing the toner as illustrated in FIG. 5.

An opening 20 is positioned in one of the outer walls 27 approximately concentric with the auger. Opening 20 is positioned such that the interior chamber 13 extends above the level of the opening. The waste toner reservoir 12 has a predetermined height, and preferably, the opening 20 is positioned at a lower half of the reservoir. The opening has a diameter d as illustrated in FIG. 5 that is approximately equal to the diameter of the helical blade.

An auger tray 30, as illustrated in FIG. 4, extends under the auger 14 for capturing the toner that is removed from the drum. In a preferred embodiment as illustrated in FIG. 7, the tray extends around the auger to prevent toner from inadvertently escaping and contacting the recording sheet or ITM belt which may lead to print errors and also prevent a user handling the cartridge from inadvertently coming in contact with the toner. Preferably, auger 14 is aligned such that the helical blade outer edge 25 is positioned closely with the inner edge of the auger tray 30 to ensure that toner is moved along the auger length and does not accumulate within the tray which could lead to over-flow toner or jamming of the auger.

Pumping cylinder 16 is positioned adjacent to the waste toner reservoir 12 and extends a distance along the auger 14. As illustrated in FIG. 4, the cylindrical section 16 has an inner wall 29 extending along the length and aligning with opening 20. Preferably, the diameter of the hole formed by the inner wall 29 is approximately equal to the diameter of the helical blades such that the toner does not accumulate within the pumping cylinder but rather is pumped through the cylinder and into the waste toner reservoir 12. Preferably, the inner wall 29 is positioned adjacent to the auger tray 30 to prevent toner from accumulating along the auger length.

In use, residual toner remaining on the drum 114 is removed by a brush, cleaner blade 126, or other known method and falls into the auger tray 30. Auger 14, having central shaft 22 and helical blade 24, moves the toner along the length of the drum and into the pumping cylinder 16. As illustrated in FIG. 4, the rotation of auger 14 results in the helical blade 24 forcing or pumping the toner from the auger tray 30, through the pumping cylinder 16, and into the interior of the waste toner reservoir 13. The close proximity of the outer blade edges 25 to the inner wall 29 of the pumping cylinder provides for the toner to move towards the waste toner reservoir and prevents the toner from backflowing out of the waste toner reservoir or pumping cylinder into the auger tray 30.

FIG. 5 illustrates areas A, B, C, D, and E of the interior 13 of the waste toner reservoir. When the reservoir is empty, toner moved by the auger drops via gravity to lower sections below the opening 20 including area A and a portion of area B. When enough toner has been introduced to fill the reservoir to the level of the opening 20, the rotating auger acts as a pump to move toner into the upper portion of area B, and areas C, D, and E that are located above the opening 20. Pumping action results from the auger blades 24 rotating through the pumping cylinder 16 and prevents toner from backing up along the length of the auger and maintains toner moving away from the photoconductive drum. The pumping action is further assisted by the portion of the auger extending into the tone reservoir. Preferably, the toner waste reservoir is sufficiently large to hold all the waste generated while printing with the toner originally available in the toner bin 122. The cartridge 110 is removed from the image forming apparatus and replaced with the new cartridge when the toner bin is depleted.

In the following description, like-reference characters designate like or corresponding parts throughout the several views. Also in the following description, it is to be understood that such terms as "forward," "rearward," "left," "right," "upwardly," "downwardly," and the like, are words of convenience and are not to be construed as limiting terms. Certain modifications and improvements will occur to those skilled in the art upon a reading of the foregoing description. A photoconductive drum is described and illustrated in the Figures, although the present invention may also be used with an image forming apparatus having other types of photoconductors, such as a photoconductive belt instead of a drum. It should be understood that all such modifications and improvements have been deleted for the sake of conciseness and readability but are properly within the scope of the following claims.

What is claimed is:

1. A toner removal device for removing toner from a photoconductive drum within an image forming apparatus comprising:

a. a waste toner reservoir positioned at an end of the photoconductive drum to contain waste toner removed from the photoconductive drum, the waste toner reservoir comprising an inlet positioned within the waste toner reservoir and having an outwardly extending pumping cylinder positioned around the inlet comprising an outer wall that forms an inner diameter; and b. an auger having a straight orientation and positioned parallel to the photoconductive drum and having a length greater than the photoconductive drum to extend through the pumping cylinder and unobstructed into an interior of the waste toner reservoir such that rotation of the auger moves toner along the photoconductive drum into the interior of the waste toner reservoir such that toner accumulates within the interior of the waste toner reservoir above the inlet.

2. The device of claim 1, further including a driven gear positioned at an end of said auger opposite said waste toner reservoir providing a means for rotating said auger.

3. The device of claim 1, wherein the pumping cylinder is positioned adjacent to the waste toner reservoir and extends a distance along the auger.

4. The device of claim 1, wherein the auger comprises a helical blade and the auger extends unobstructed into the interior of the waste toner reservoir a distance at least as great as two units of the helical blade.

5. A cartridge for an image forming apparatus comprising:

a. a waste toner reservoir having an inlet and an internal chamber that extends at least above the inlet;

b. a photoconductive drum;

c. a toner bin to supply toner to the photoconductive drum;

d. a blade to remove the toner from the photoconductive drum;

e. a tray to capture the toner that is removed from the photoconductive drum;

f. an auger positioned within the tray to move the toner into the internal chamber of the waste toner reservoir, the auger extending through the inlet and unobstructed into the internal chamber of the waste toner reservoir;

g. a driving means for rotating the auger to pump toner within the internal chamber above the inlet; and h. wherein a height and width of the waste toner reservoir extend beyond the photoconductive drum, toner reservoir, blade, tray, and auger relative to one side of the image forming apparatus.

6. The device of claim 5, wherein said waste toner reservoir has a predetermined height and said inlet is positioned in a lower half of said predetermined height.

7. The device of claim 5, wherein said auger comprises a helical blade having a diameter approximately equal to a diameter of said inlet for pumping toner into said waste toner reservoir.

8. The device of claim 5, wherein said waste toner reservoir is sized to contain a portion of the toner contained within said toner bin that is not transferred to a print media.

9. The cartridge of claim 5, wherein the photoconductive drum, auger, and tray are aligned substantially perpendicular to the waste toner reservoir.

* * * * *